United States Patent [19]

Ristvedt

[11] Patent Number: 4,564,036

[45] Date of Patent: Jan. 14, 1986

[54] COIN SORTING SYSTEM WITH CONTROLLABLE STOP

[75] Inventor: Victor G. Ristvedt, Manchester, Tenn.

[73] Assignee: Ristvedt-Johnson, Inc., Mount Prospect, Ill.

[21] Appl. No.: 532,616

[22] Filed: Sep. 15, 1983

[51] Int. Cl.[4] ..... G07D 3/14

[52] U.S. Cl. ..... 133/3 A; 133/8 R

[58] Field of Search ..... 133/3 R, 3 A, 3 B, 3 C, 133/3 D, 3 E, 3 F, 3 G, 3 H, 8 R, 8 A

[56] References Cited

U.S. PATENT DOCUMENTS

| | | | |
|---|---|---|---|
| 1,894,190 | 1/1933 | Myers | 133/3 R |
| 1,979,659 | 11/1934 | Zierick | 133/3 A |
| 2,231,642 | 2/1941 | Seemel | 133/8 R |
| 2,906,276 | 9/1959 | Blanchette et al. | 133/3 R |
| 2,977,961 | 4/1961 | Buchholz et al. | 133/3 R |
| 3,771,538 | 11/1973 | Reis | 133/3 D |
| 3,837,139 | 9/1974 | Roseberg | 133/8 R X |
| 4,086,928 | 5/1978 | Ristvedt et al. | 133/3 A |
| 4,098,280 | 7/1978 | Ristvedt et al. | 133/3 A |
| 4,234,003 | 11/1980 | Ristvedt et al. | 133/3 A |

FOREIGN PATENT DOCUMENTS 2012863 1/1970 Fed. Rep. of Germany .

*Primary Examiner*—F. J. Bartuska

[57] ABSTRACT

The invention relates to a coin sorter apparatus for sorting a group of mixed coins by denomination and terminating the sorting process when a predetermined number of coins have been sorted. A stationary disk provides a means for guiding the outwardly radial movement of coins rotating on the surface of a rotating disk from a starting point at the center of the stationary disk to an exit at selected areas at the periphery of the stationary disk. The radial positions of the coins are controlled so as to cause the coins exiting at the selected areas to be sorted by coin denomination. Sensors located proximate to these selected areas count the number of coins exiting at each area. A recycling recess and bridge guide combination are responsive to a predetermined count of any of the sensors to redirect the outwardly radial movement of the coins to an inwardly radial movement which recycles coins to the center of the stationary disk in order to immediately terminate the sorting function in response to the detected predetermined number of sorted coins exiting from any of the selected areas.

14 Claims, 4 Drawing Figures

COIN SORTING SYSTEM WITH CONTROLLABLE STOP

FIELD OF THE INVENTION

The present invention relates generally to an apparatus and method for sorting coin currency by denomination and, more particularly, to an apparatus and method for sorting coins by denomination which stops the sorting process after a predetermined number of coins have been sorted.

BACKGROUND OF THE INVENTION

Some businesses, particularly banks, are often faced with a large amount of coin currency at the end of a business day, week or month which must be organized, counted and recorded. To hand count and record large amounts of coins of mixed denomimations requires diligent care and effort and demands much manpower time that might otherwise be available for more profitable and less tedious activity. To make counting of coins less laborious, machines have been developed which automatically sort by denomination a mixed group of coins.

It is desirable that such machines be able to sort coins without requiring constant monitoring. Typically coins are sorted into receptacles. Improved sorting efficiency results if the receptacles can be filled to a predetermined number of coins and then removed from the sorter apparatus. Otherwise, the user of the sorter apparatus must recount the sorted coins in order to determine the total number of coins held in the receptacle.

SUMMARY OF THE INVENTION

It is the primary object of this invention to provide an improved coin sorter mechanism which is capable of automatically sorting and counting coins at a high speed and quickly terminating the sorting process when a predetermined number of a coin denomination has been sorted into a receptacle. It is a related object of this invention to provide a mechanism which automatically terminates sorting coins when a coin receptacle is filled with a predetermined number of coins.

It is also an object of the invention to provide a coin sorter apparatus which can be safely left for unattended operation without any danger of overflow, jamming or excessive coin abrasion.

It is still another object of this invention to provide a coin sorter apparatus which quickly stops the flow of coins through the sorting mechanism in a simple and reliable fashion in response to a predetermined condition that can be represented by an electrical signal.

It is yet another object of this invention to provide a coin sorter mechanism which satisfies the foregoing objects and whose size allows it to be easily and conveniently placed in the work space of most businesses.

Other objects and advantages of the invention will be apparent from the following detailed description.

The invention relates to a coin sorter apparatus for sorting a group of mixed coins by denomination and terminating the sorting process when a predetermined number of coins have been sorted. A stationary disk provides a means for guiding the outwardly radial movement of coins rotating on the surface of a rotating disk from a starting point at the center of the stationary disk to an exit at selected areas at the periphery of the stationary disk. The radial positions of the coins are controlled so as to cause the coins exiting at the selected areas to be sorted by coin denomination. Sensors located proximate to these selected areas count the number of coins exiting at each area. A recyling recess and bridge guide combination are responsive to a predetermined count of any of the sensors to redirect the outwardly radial movement of the coins to an inwardly radial movement which recycles coins to the center of the stationary disk in order to immediately terminate the sorting function in response to the detected predetermined number of sorted coins exiting from any of the selected areas.

Although the invention will be described in connection with certain preferred embodiments, it will be understood that it is not intended to limit the invention to those particular embodiments. On the contrary, it is intended to cover all alternatives, modification and equivalents that may be included within the spirit and scope of the invention as defined by the appended claims.

DESCRIPTION OF THE PREFERRED EMBODIMENT

Figure 1:
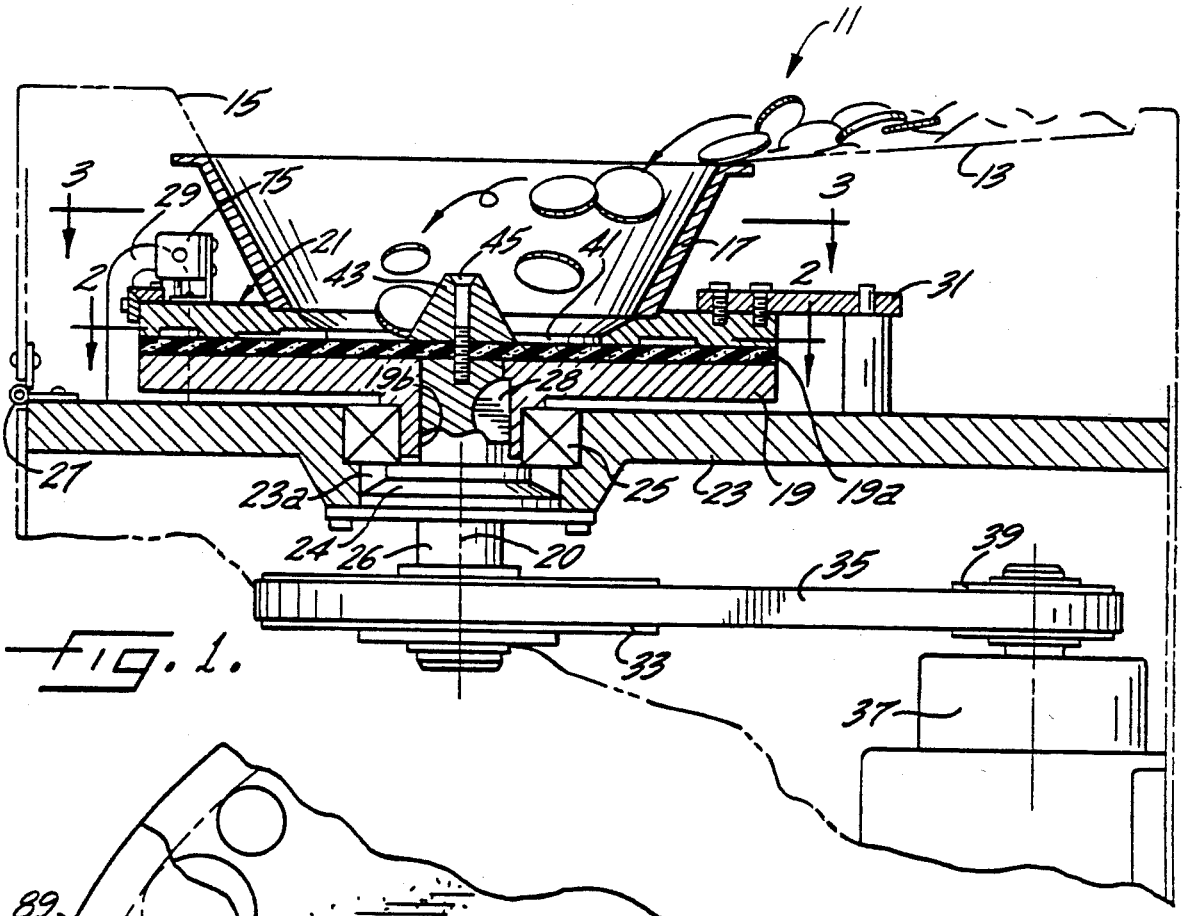
FIG. 1 is a cross-sectional view of a coin sorter apparatus which can utilize the recycle mechanism according to the invention.

Referring first to FIG. 1, a coin sorter machine is shown which might utilize the coin sorter apparatus according to the invention to rotate coins in an outwardly spiraling orbit and eject each different denomination of coin from the sorting apparatus at a different selected location into a receptacle. In response to a condition signal the coin sorter apparatus redirects the coins into an inwardly spiral orbit which re-circulates the coins to the center of the coin sorter apparatus.

To start the sorting process a collection of mixed denomination coins 11 is dropped onto a staging platform 13 which is an integral part of a housing cover 15. The coins 11 are manually pushed along the gentle sloping incline of the staging platform 13 and fall into a hopper 17 as indicated by the arrows in FIG. 1. The coins are directed by the hopper 17 into the coin sorter apparatus which is comprised of a rotating disk 19 and a stationary disk 21, shown in cross-section in FIG. 1. The stationary disk 21 contains recesses and ridges on its bottom surface whose purpose will be explained in greater detail in connection with FIGS. 2–7.

A resilient pad **19*a* provides the top surface for the rotating disk 19. This pad 19*a* is firmly secured to the disk 19 and, therefore, rotates along with the disk 19 about its center axis 20. Because the rotating disk and stationary disk are held closely together, coins which rotate on the resilient pad 19*a*** are brought into the region between the disks and selectively pressed into the pad by the stationary disk's ridges and recesses. As a result, the rotating coins are selectively allowed to move outwardly to the disk periphery in response to centrifugal force. Each denomination of coin reaches the periphery at a different location relative to the stationary disk. Therefore receptacles can be fixed at these locations to catch the sorted denominations.

Since coins are alternately pressed into and released from the pad, the pad 19*a* should be a rubber composition with a resilience of about 30 to 35 durometers. The stationary disk may be formed by machining a preheated steel core and then surface treating the disk for additional hardness by a well known gas nitriding process. Support for the sorter apparatus is provided by a base 23 which has an opening 23*a* that receives a drive shaft section 19*b* of the rotating disk 19. To allow the rotating disk 19 to turn relative to the stationary base 23, a bearing 25 is fitted between the shaft section 19*b* of the rotating disk 19 and the opening 23*a* of the base 23. To relieve the bearing 25 of the weight of the coin sorter apparatus and to prevent cantilevering of the bearing, a collar and support plate 24 are mounted at the bottom mouth of opening 23*a*.

A drive shaft 26 with a slotted key 28 extends from the drive shaft section 19*b* of the rotating disk through the collar and support plate 24. To turn the drive shaft 26 a pulley 33 is attached to the drive shaft bottom end. The pulley 33 is connected by a belt 35 to a motor 37 which also has a pulley 39 at the end of its drive shaft. The belt and pulley drive acts like a clutch mechanism by allowing the belt to slip on the pulleys in the event that coins jam between the rotating disk 19 and the stationary disk 21.

To facilitate maintenance and repair, the housing cover 15 is hinged to the base 23 by hinge 27 and the stationary disk 21 is attached to the base 23 by way of hinge 29. On the opposite side of the stationary disk from the hinge 29 is a support structure 31 which supports the stationary disk 21 in horizontal alignment over the rotating disk 19 and also provides a handle to lift the stationary disk 21 about the pivot 29. The support structure 31 and pivot 29 also fix the vertical position of the stationary disk 21, holding it close to the surface of the resilient pad 19*a* but not touching it. This avoids any possibility of degradation of the resilient pad surface through frictional wear against the stationary disk.

As can be seen in the cross-section of FIG. 1, the stationary disk 21 has a central opening 41 which exposes a portion of the resilient pad 19*a* such that coins dropped from the hopper 17 land on the resilient pad 19*a* of the rotating disk 19. Because the coins tend to move on the rotating disk in a spiraling orbit, the central opening 41 is circular in shape in order to allow for this natural movement. To prevent bunching of the coins in the center of the exposed portion of the resilient pad 19*a*, a conical projection 43 is secured by a screw 45 to the rotating disk 19 at the rotational center of the disk.

When the coins are dropped onto the exposed central surface portion of the rotating disk 19, they react to the centrifugal force imparted on them by the rotating disk by moving toward the annular side wall of the central opening 41 cut in the stationary disk 21. Simultaneously and in combination with this outward movement the coins are carried by the rotating disk 19 in an orbit about the disk's rotational center. Together these movements describe an outwardly spiraling orbit as viewed from the perspective of a stationary observer. When a coin's edge reaches the annular side wall of the central opening, its outward movement is restrained by the wall.

The annular side wall of the central opening includes a recess which allows single coins, but not multiple layered coins, to slide under the stationary disk. As will be explained in greater detail in connection with FIG. 2, coins which slide into the recess are captured between the two disks by a series of ridges and recesses in the stationary disk and are guided by these ridges and recesses to predetermined destinations which are different for each coin denomination. Due to cooperation between the resilient surface of the rotating disk and the ridges and recesses of the stationary disk, the coins' radial movements are, in part, guided by alternately pressing the coins into the rotating disk and releasing them as the rotating disk carries the coins in an orbit under the stationary disk. As a complement to this, edges composed of junctions between ridges and recesses guide the orbit of the coins by creating barriers to the radial movement of the coins. The recesses and ridges of the stationary disk are strategically positioned along the rotational path of the coins so as to utilize the centrifugal force imparted on the coins by the rotating disk in such a way as to sort the coins by denomination.

A useful way to describe the functional interrelationship of the rotating disk and stationary disk is to view the stationary disk as a guiding mechanism. If the stationary disk were removed from its position proximate to the surface of the rotating disk, coins placed on the rotating disk would exhibit an orbital path having a constant radial component as a result of the unhampered centrifugal force acting on the coins. As a result the coins would be flung off the rotating disk surface in a haphazard manner. The stationary disk serves to controllably guide the radial movement of the coins and thereby impart to the coins a controlled orbit which steadily increases. While on route in this controlled outwardly spiraling orbit or arcuate path, the coins are sorted by the guiding action of the stationary disk.

Each area of ridges and recesses in the stationary disk guides the coins in a particular manner to prepare the coins for the journey to and manipulation by a following area of ridges and recesses. Guiding is provided by an edge or side wall defined by a combination of a ridge and recess which serves as a guide surface for the edges of the coins which are urged against the side wall by centrifugal force. By selective guiding of the coins by the stationary disk, the coins are carried in an outwardly spiral orbit on the resilient surface of the rotating disk which segregates the coins by denomination.

As the coins are carried on the rotating disk their path comprises two well defined movements between the surface of the stationary disk and the rotating disk. If the coins are kept pressed into the pad by the ridges and recesses of the stationary disk, the coins will not move radially under the influence of centrifugal force but will be carried on the resilient pad at a constant radius to define a circular orbital path about the center of the rotating disk. If during their orbit the coins are brought into a recess in which the coins are not pressed into the pad, the coin will move outwardly on the pad in response to centrifugal force, thus giving the coin orbit a radial component which moves the orbit farther out from the disk center until the orbit's radial component is met by an edge of a ridge-recess combination in the stationary disk. As long as the coins are not pressed into the resilient pad 19*a* they will remain against the stationary disk edge as they continue to orbit. In short, the recesses and ridges in the bottom surface of the stationary disk take advantage of the natural movement of the coins as they orbit to position the coins at particular disk radii which align their orbits so that recesses in the stationary disk encountered by the rotating coins will selectively exit the coins from between the two disks.

Figure 2:
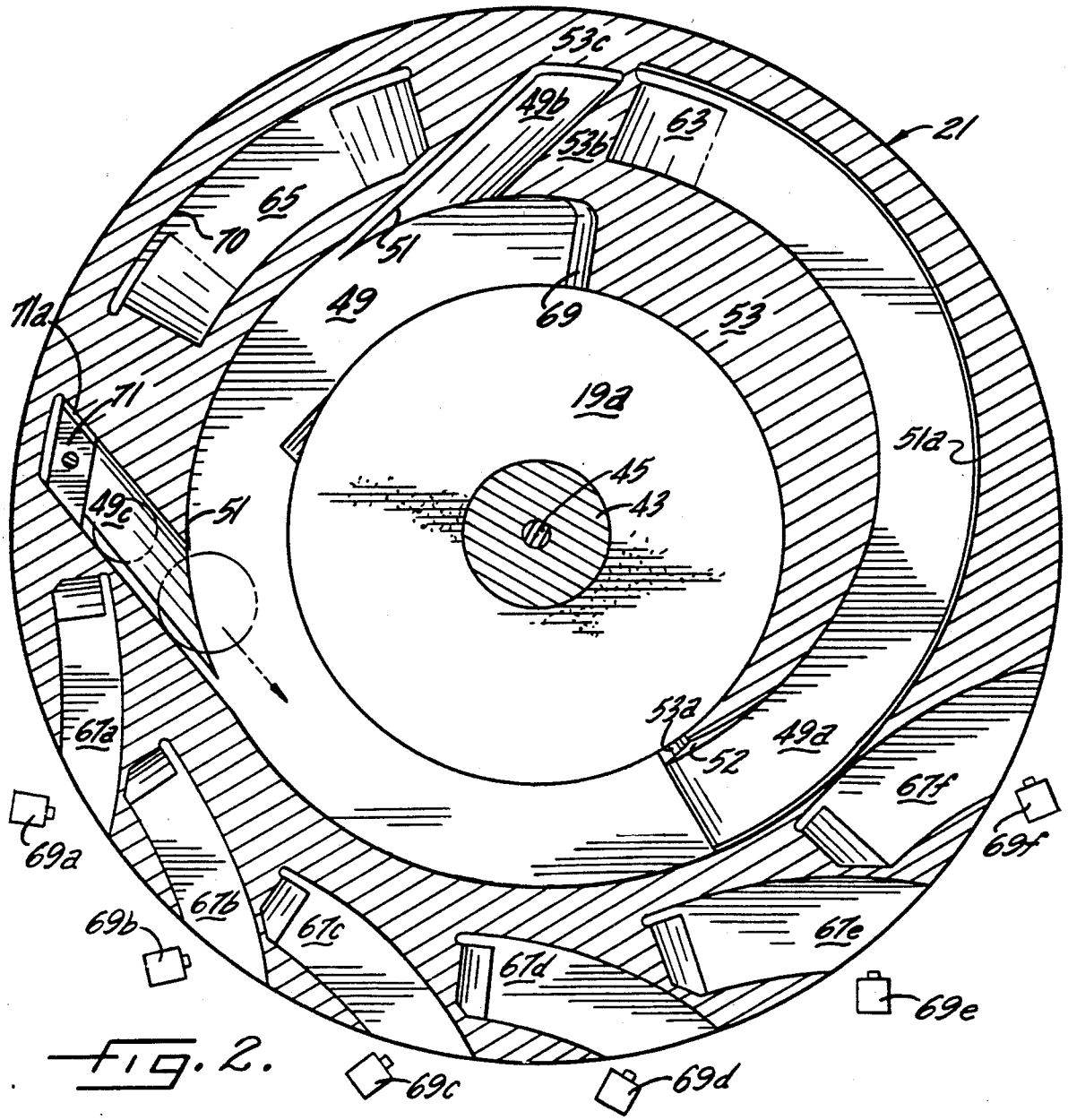
FIG. 2 is a full sectional view of the stationary disk of the coin sorter apparatus taken along the line 2—2 in FIG. 1 showing the location of the guide element of the recycle mechanism.

Referring now to FIG. 2, the ridge region 53 occupies a large portion of the surface of the stationary disk facing the resilient pad 19*a*. The ridge region 53 is parallel with the resilient pad 19*a*, and sufficiently proximate to it so that coins of all denominations are pressed into the pad when they pass under the ridge region 53. As long as a coin is pressed into the pad it will be carried on the pad at a fixed location and will rotate under the recesses and ridges of the stationary disk at a constant radial position as determined by the last recess in which the coin was allowed to move radially.

To facilitate an understanding of the coin movement, the lowermost surface 53 of the stationary disk has been cross-hatched in FIG. 2 to serve as a reference plane for the recesses in the disk. The non-cross-hatched areas of the stationary disk correspond to recessed areas of various depths. Also to facilitate understanding of coin movement, adjoining recesses with related depths have been designated with the same numeric identifier and an individual alpha identifier (e.g., 49, 49*a*, 49*b*, 49*c*).

As mentioned in connection with FIG. 1, to begin its journey, a coin is dropped from the staging area 13 and hopper 17 onto the resilient pad 19*a* of the rotating disk 19. As can be seen in FIG. 2, the stationary disk 21 has a recess 49 which first receives the rotating coins on the rotating disk 19 under the surface of the stationary disk 21. In order to insure that two coins layered together do not enter the recess 49, the recess is only deep enough to accept the thickest coin. As the coins are accepted into the recess 49 they are being carried on the pad surface in an orbit about the center of the rotating disk while simultaneously moving radially over the pad surface toward the disk periphery. Radial movement of the coins is limited by the outer edge 51 of the recess 49.

As the rotating disk 19 rotates under the stationary disk the coins are carried through the recess 49 to recess 49*a*. Recess 49*a* has approximately the same depth as recess 49, and therefore has a depth sufficient to not press the coins into the resilient pad 19*a*. Consequently the coins can move radially to the edge 51*a* which guides the edge of the coin as the coin moves along the recess 49*a*.

At this point, with portions of ridge 53 on either side of recess 49*a*, the recess and ridge form a channel which captures, in a single file, those coins which have been guided by edge 51. To ensure larger diameter coins do not get stuck against the inside edge of the recess (because of the slight wedging action caused by the recess edges being slightly less than vertical) the inside edge of recess 49*a* includes a bulged area 52. This bulged area gives enough room in the recess 49*a* for the larger diameter coins to succumb to the centrifugal force and move to the outside edge 51*a* of recess 49*a*.

If a coin is not properly aligned by edge 51 before it approaches the entrance to recess 49*a*, it will be intercepted by a segment 53*a* of the ridge 53. Ridge 53*a* presses the coin into the resilient pad 19*a* and prevents the coin from moving radially. The coin thus moves with the rotating disk under ridge 53*a* in a circular counterclockwise arc to where ramp 69 releases the coin into region 49 again; as described previously, recess 49 releases the coin from pressed engagement with the pad so that the coin is free to move radially toward edge 51. The coin released by ramp 69 will move radially outward under the influence of centrifugal force and will be guided by edge 51 which directs the coin movement into recess 49. Now the coin is on the correct path to properly enter recess 49*a*.

In the recess 49*a* the coins are in a single file and are guided by edge 51*a* which adjusts the radial position of the coins. At the end of recess 49*a* the coins are pressed into the resilient pad 19*a* by a wedge 63 which is an incline bridging the depth level of recess 49*a* with the ridge 53. As the coins are carried by the rotating disk 19, the coins are steadily pressed into the resilient pad 19*a* as the rotating coins are moved under the gradual incline of the wedge 63. Further movement of the coins on the rotating disk 19 brings the coins partly under a recess 49*b*.

Because a coin of relatively small diameter may not be caught by the ridge 53*a* and yet may be misaligned in the recess 49*a*, recess 49*b* provides a path to return these misaligned coins to the center of the resilient pad 19*a* for re-circulation. Coins adjacent to a misaligned coin could prevent the misaligned coin from moving out radially to meet the outer edge 51*a* of the recess 49*a*. If this misalignment were not corrected, the coin could be led into the recess 65 at a misaligned radial position which could result in the coin improperly exiting from one of the recesses 67*a*–67*e* or possibly not exiting at all and jamming the machine.

As correctly aligned coins leave recess 49*a* they will be pressed into the pad by the wedge 63 and ridge 53*b*, and they will be kept pressed into the pad by the ridge 53*c* as they pass under recess 49*b*. Since the coins are pressed into the pad, they cannot move radially in response to centrifugal force. Instead the coins follow a path of constant radius. Even though the correctly aligned coins pass partly through recess 49*b*, some portion of each coin is always in contact with the ridges 53, 53*b* or 53*c* (the cross-hatched area). Accordingly, the coins are pressed into the resilient pad throughout their journey past recess 49*b*. As the coins are held pressed into the pad by the ridge 53, the coins rotate along a constant-radius arc into recess 65.

As misaligned coins leave recess 49*a* they will also be pressed into the resilient pad 19*a* by wedge 63 and held in pressed engagement with the pad by the ridge 53*b*. Since misaligned coins are located at a radial position spaced inwardly from that of correctly aligned coins, the outer edges of such coins do not stay under ridge portion 53*c*. Therefore, the misaligned coins are released from a pressed engagement with the resilient pad 19*a* by the recess 49*b*.

Although most of the recesses have bottom surfaces which are approximately parallel with the resilient pad 19*a*, the recess 49*b* is slightly angled (e.g., $5\frac{1}{4}$ degrees) with respect to the pad surface. Such an angle allows misaligned coins to ramp up the recess and away from pressed engagement with the pad. When the leading edges of misaligned coins hit the extension of the wall 51 in recess 49*b* they are sufficiently free from pad pressure to move radially inwardly. The edge 51 of the recess 49*b* guides the coins back into recess 49 for another attempt at proper alignment within recess 49*a*.

Any coin denomination of a diameter less than the width of the recess 49*a* can experience the problem of misalignment. In practice, the larger the diameter of a coin, the less likely the coin is to be misaligned in recess 49*a*. In fact, experience indicates that only small diameter thin coins, are misaligned in recess 49*a*. Nevertheless, coins which have a diameter greater than the width of recess 49*b*, yet small enough to be misaligned in recess 49*a*, such that their radially outside edge is located inwardly of ridge 53*c*, can also be guided by recess 49*b* back to recess 49. Even though part of the coin remains under ridge 53*b* (because of its diameter being larger than the width of recess 49*b*) the coin's leading edge meets edge 51 which successfully guides the coin radially inwardly.

It can occur that correctly aligned coins passing under recess 49*b* can be slightly shifted in their radial position. To correct this, correctly aligned coins pass recess 49*b* and enter recess 65 which allows the coins to be realigned against the radially outer edge 70 of the recess 65. Recess 65 and edge 70 allow the coins in the sorting path an opportunity to realign their outer edges at the radial position required for correct sorting.

From the recess 65 the pad rotation carries the radially correctly aligned coins into an area of the stationary disk which has a series of recesses 67*a*–67*f* for allowing properly sized and positioned coins to exit from between the disks. Each of the recesses 67*a*–67*f* acts as an exit chute for a particular coin denomination by releasing that particular coin from pressed engagement with the pad 19*a*. After the coins have been released from the pad, they are free to move radially along the recess and exit into a coin receptacle.

Since all denominations have their outer edges guided to the same radial position by edge 70, it is only the coin inner edge which is at a unique radial distance for each denomination. Therefore, the associated recesses 67*a*–*f* which allow the different coins to exit from between the disks must be arranged on the stationary disk so that the coins pass under them in an order of ascending width. To accomplish this, the recesses 67*a*–67*f* are aligned in a counterclockwise order of ascending width.

At the periphery of the stationary disk 21 and proximate to each opening for recesses 67*a*–*f*, a series of counters 69*a*–*f* are positioned. Each counter utilizes a device, such as a conventional quenched oscillator, to sense the coins leaving the recess 67*a*–*f* and thereby keep an accurate count of the sorted coins in each receptacle.

In accordance with an important aspect of the invention, a retractable bridge guide 71 can be lowered or raised between two positions so as to allow coins to pass unobstructed in a first position, and thus allow the sorting function to operate, or to block the passage of coins in a second position and thus cause the coins to be recirculated radially inwardly back to the center opening of the stationary disk 21 when one of the counters 69*a*–*f* reaches a predetermined total. Bridge guide 71 is an insert in recess 49*c* which is substantially the same as recess 49*b* except that with bridge guide 71 in its raised position *all* coins in the sorting path are intercepted by the recess. By placing the bridge guide 71 in its raised position, the radial extent of the recess 49*c* is increased to a point past the radial distance of the circumferential sorting path of coins exiting recess 65 and approaching recesses 67*a*–*f*. As indicated by the coins represented in recess 49*c*, and as explained in connection with recess 49*b*, coins of all diameters are capable of being re-circulated by the recess 49*c*.

The bridge guide 71 in FIG. 2 has a flat bottom surface which occupies a co-planar position with ridge 53 when in its second position. Coins passing under recess 49*c* when the bridge guide is in its lowered position will not be moved radially inwardly since the bridge guide 71 holds the coin in pressed engagement with the resilient pad and prevents the coin leading edges from ramping along the slope of the recess 49*c* into engagement with edge 51. As the arrow indicates in FIG. 2, the bridge guide 71 when in its raised position redirects coins away from the sorting path to the recess 49 and toward the central area of the resilient pad 19*a*.

Figure 3:
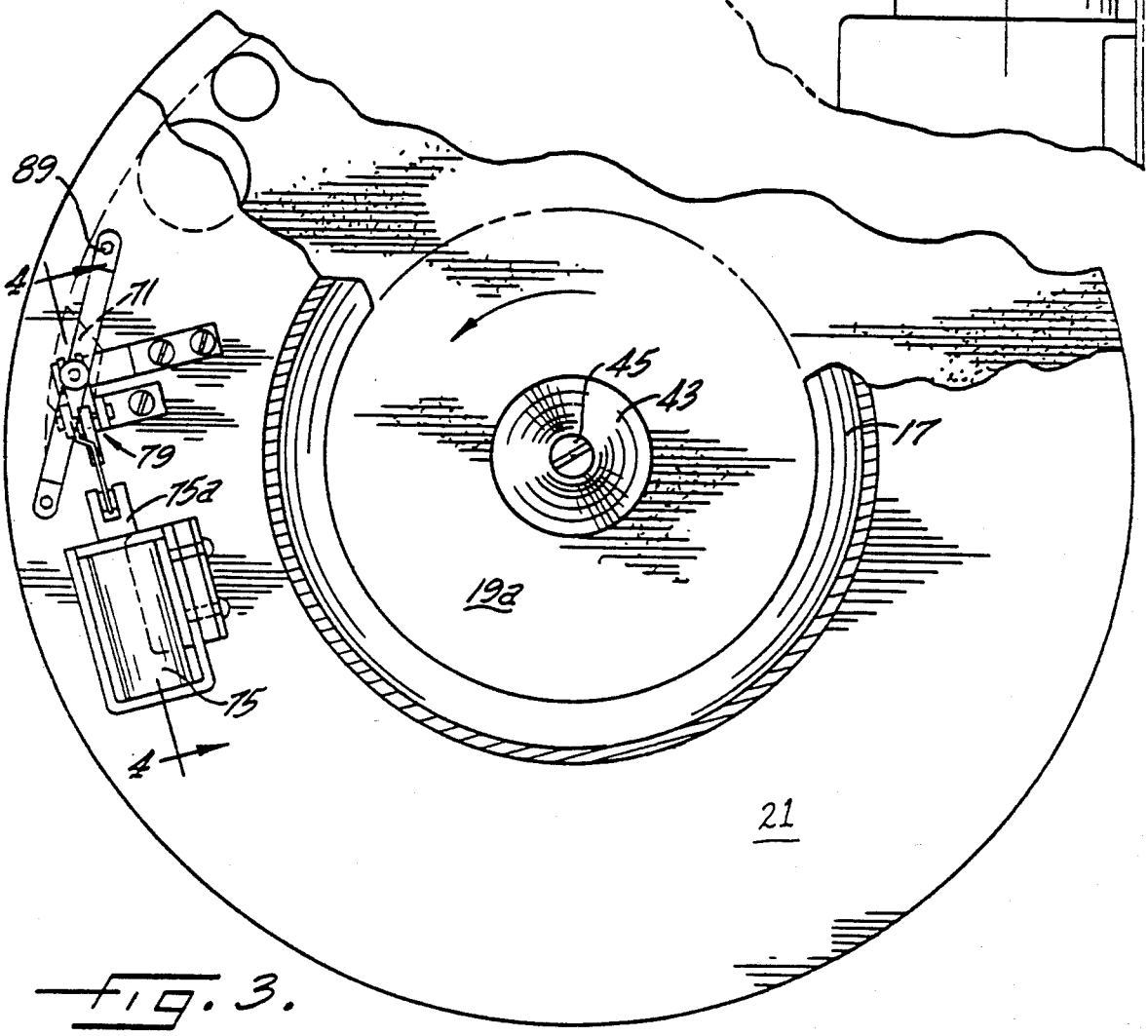
FIG. 3 is a partial sectional view of the coin sorter apparatus taken along the line 3—3 in FIG. 1 showing the top of the stationary disk and that part of the recycle mechanism which controls the position of the guide element.

Referring now to FIG. 3, the bridge guide 71 is moved between its raised and lowered position by a solenoid 75 positioned on the top surface of the stationary disk 21. In order to stop the sorting process and re-circulate the coins to the central area of the rotating disk and stationary disk, the plunger 75*a*, by way of the linkage 79, raises the bridge guide. The solenoid is responsive to the counters 69*a*–*f* so as to energize the solenoid coil and pull in the plunger when any of the counters indicates a full receptacle.

Figure 4:
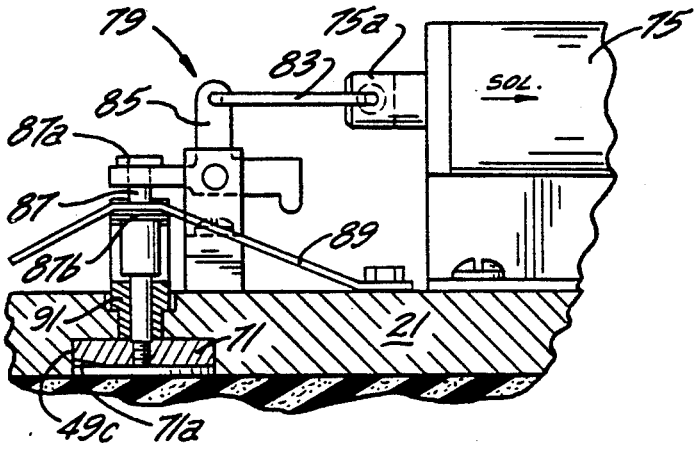
FIG. 4 is a cross-sectional view of the recycle mechanism taken substantially along the line 4—4 in FIG. 3.

Referring now to FIG. 4, the solenoid, linkage and bridge guide combinations are shown in cross-section to better illustrate their interconnection. Bridge guide 71 is shown in the position in which it is held by an activated solenoid. It is held in a raised position so as to radially extend the recess 49*c* to capture all coins traveling along the sorting path. In order to ease tolerances and yet assure proper performance of the bridge guide 71, the beveled bridge surface 71*a* which first contacts coins in the sorting path is angled with respect to the ridge 53 and resilient pad 19*a* so as to gradually bring coins into contact with the bottom surface of the bridge guide. Since the bridge guide might not necessarily be perfectly co-planar with ridge 53 when in its lowered position, a right angle leading edge might be lower than ridge 53 and act as a guide edge which diverts coins inwardly instead of allowing them to pass unchanged.

Connecting the bridge guide 71 to the plunger 75*a* is the linkage 79 composed of rod 83, rocker arm assembly 85 and arm 87. Rocker arm assembly 85 has one end coupled to the head portion 87*a* of arm 87. A leaf spring 89 secured to the surface of the stationary disk is positioned over a central platform area 87*b* of the arm 87. The bottom of the arm is threaded to the bridge guide 71 through a bushing 91 which allows the arm 87 to move vertically. When the solenoid 75 is unenergized, the leaf spring 89 holds the bridge guide 71 in its lowered position. Activation of the solenoid 75 moves the plunger 75*a* to the right in FIG. 4, thus causing the linkage 79 to pull the arm 87 and the attached bridge guide 71 up to the guide's raised position.

It will be appreciated that the solenoid 75 can be activated by signals other than those from a counter. For example, it might be desired to have a manually operated switch for terminating the sorting operation in response to a machine malfunction. Similarly, in certain applications it might be desirable to terminate sorting in response to a signal representing an elapsed time period, or the accumulation of a preselected weight of coins of a given denomination.

It can be seen from the foregoing that the sorter apparatus according to the invention can automatically and quickly terminate the high-speed sorting function in response to the sensing of a filled receptacle. By automatically re-circulating coins to the center of the stationary disk in response to an indication of a filled receptacle, the coin sorter apparatus may be left unattended without fear of jamming or fouling of the apparatus.

I claim:

1. A coin sorter apparatus for receiving and sorting mixed coins by denomination comprising:

a rotating disk having a first surface for receiving said mixed coins and imparting a rotational movement to said mixed coin, a stationary disk having its underside parallel with and proximate to said first surface of said rotating disk for guiding said mixed coins along a sorting path, a central open area in said stationary disk for allowing coins to be received onto said first surface of said rotating disk, a first area on the underside of said stationary disk including means for selectively directing and rotating mixed coins into a sorting path within the region between the two disks, with said region allowing continued rotation of the mixed coins on the first surface of said rotating disk, a second area on the underside of said stationary disk including means for receiving and rotating coins from said first area in a single file configuration and manipulating the radial position of each denomination of said coins, a third area on the underside of said stationary disk including means for receiving and rotating coins from said second area and allowing rotating coins positioned at predetermined radial positions to exit said region between the two disks at predetermined locations along the periphery of the stationary disk, a plurality of counter means located at each predetermined location and responsive to the exiting of coins so as to provide an accurate count of coins leaving the sorter apparatus at each predetermined location, and a fourth area on the underside of said stationary disk between said second area and said third area including means responsive to each of said counter means for intercepting coins from said second area and guiding them to said central open area when any of said counter means reaches a predetermined count.

2. A coin sorter apparatus for receiving and sorting mixed coins by denomination as set forth in claim 1 wherein said fourth area includes a recess which guides coins radially inwardly.

3. A coin sorter apparatus for receiving and sorting mixed coins by denominations as set forth in claim 2 wherein said recess includes a bridge guide mounted for movement between a first and second position and which spans the radially outer portion of said recess when in said first position so as to permit coins in said sorting path to pass by said recess undisturbed, and which extends the radially outer portion of said recess in said second position so as to intercept and recycle all coins in the sorting path.

4. A coin sorting apparatus for sorting a group of mixed coins by denomination and terminating the sorting process when a predetermined number of coins have been sorted, said apparatus comprising:

rotating means for imparting a rotational movement to said group of mixed coins, stationary means proximate to said rotating means, for guiding the rotating coins from the center of said stationary means through a region between said rotating and stationary means to the periphery of said stationary means by way of a radially outward spiral sorting path such that the rotating coins exit at the periphery of the stationary means at discrete locations determined by coin denomination, counter means located proximate the periphery of said stationary means for counting the number of sorted coins of each denomination, and recycle means in said stationary means responsive to a predetermined count total of any coin denomination by said counter means for redirecting said rotating coins in said region inwardly such that the rotating coins are returned to the center of the stationary means so as to prevent exiting of the coins at the periphery of said stationary means.

5. A coin sorter apparatus as set forth in claim 4 wherein said recycle means is mounted in said stationary means for movement in and out of the radially outward spiral sorting path of the coins.

6. A coin sorter apparatus as set forth in claim 5 wherein said recycle means comprises a recess for intercepting coins in said radially outward spiral sorting path and guiding the coins along the recess edge back to the center of said stationary means.

7. A coin sorter apparatus as set forth in claim 6 wherein said recess contains a bridge guide which is moveable between at least first and second positions so as to bridge at least a portion of said recess in said first position to thereby not allow said recess to reverse the radial movement of said coins and said bridge guide exposing at least a portion of said recess in said second position to thereby cause the coins in the sorting path to be guided radially inwardly by the recess edge.

8. A coin sorter apparatus as set forth in claim 4 wherein said recycle means comprises a recess for intercepting coins in said radially outward spiral sorting path and guiding the coins along the recess edge back to the center of said stationary means.

9. A coin sorter apparatus as set forth in claim 4 wherein said recycle means includes a recess for directing coins radially inwardly and a bridge guide moveable within the recess between at least first and second positions with said bridge guide in said first position bridging at least a portion of said recess to thereby prevent coins in the sorting path from entering the recess and said bridge guide in said second position exposing at least a portion of said recess to thereby cause said recess to intercept coins in the sorting path and guide them radially inwardly so as to prevent exiting of the coins at the periphery of the stationary means.

10. A coin sorter apparatus as set forth in claim 4 wherein said stationary means (a) guides the outer edges of the rotating coins in said sorting path to a predetermined radial position on said rotating means and thereafter (b) guides the coins to a series of discharge surfaces in said stationary means which causes the coins to exit at predetermined locations at the periphery of said stationary means, and said recycle means including a controllable bridge means spanning a recess, said controllable bridge means occupying a first position which permits coins whose outer edges are in said predetermined radial position to pass said recess with said controllable bridge means being moveable to a second position which exposes said recess to coins in said sorting path at said predetermined radial position and causes these coins to be redirected radially inwardly.

11. A coin sorter apparatus as set forth in claim 4 wherein said recycle means includes an electromagnetic means and a bridge guide in which said electromagnetic means is responsive to said counter means to move said bridge guide between at least a first and second position, and said first position allowing coins in the sorting path to exit at the periphery of said stationary means and said second position intercepting coins in said sorting path and redirecting the coins radially inwardly so as to prevent their exit at the periphery of the stationary means.

12. A coin sorter apparatus as set forth in claim 11 wherein said bridge guide bridges a recess in said stationary means in said first position and exposes said recess in said second position such that rotating coins in the sorting path are intercepted by said recess and returned to the center of said stationary means for re-circulation.

13. A method for terminating the sorting of coins by a stationary disk and a rotating disk mounted with the surfaces parallel to, and in close proximity with, one another, said method comprising the steps of:

(a) rotating the coins on said rotating disk, (b) radially outwardly guiding the coins with the stationary disk into the region between said stationary and rotating disks in a single file circumferential path so as to position the radially inner edge of each coin denomination at a unique radial position, (c) intercepting each denomination and exiting that denomination from the periphery of the stationary disk into receptacles positioned at different discrete locations for each denomination, (d) counting said coins as they exit the stationary disk at each discrete location, (e) reaching a predetermined count at any of the discrete location, and (f) radially inwardly redirecting said coins in said single file circumferential path in said region back to the center of said stationary disk so as to stop further exiting of sorted coins at the periphery of the stationary disk.

14. A method for re-circulating coins as set forth in claim 13 including the steps of:

(g) emptying the receptacle filled with the predetermined number of coins, and (h) releasing said coins in the single file circumferential path from the radially inward path and returning said coins to the radially outward path so as to allow coin sorting to continue.

* * * * *